US006511262B2

(12) United States Patent
Kang

(10) Patent No.: US 6,511,262 B2
(45) Date of Patent: Jan. 28, 2003

(54) SOLIDIFIED COMPOSITION TO STRENGTHEN WEAK STRATUM AND CONSTRUCTING METHOD USING THE SAME

(76) Inventor: Soo-Yong Kang, New Town Apt. 13-1201, Bisan-3dong 341, Dongan-ku, Anyang-si, Kyunggi-do 431-819 (KR)

( * ) Notice: Subject to any disclaimer, the term of this patent is extended or adjusted under 35 U.S.C. 154(b) by 0 days.

(21) Appl. No.: 09/802,245

(22) Filed: Mar. 8, 2001

(65) Prior Publication Data

US 2001/0028829 A1 Oct. 11, 2001

(30) Foreign Application Priority Data

Mar. 9, 2000 (KR) ..... 00-11808

(51) Int. Cl.[7] ..... C09K 17/00; E02D 3/00

(52) U.S. Cl. ..... 405/302.4; 405/229; 405/266; 106/713; 106/799; 106/900

(58) Field of Search ..... 106/713, 798, 106/799, 733, 900; 405/229, 266, 302.4, 263

(56) References Cited

U.S. PATENT DOCUMENTS

| | | | | | |
|---|---|---|---|---|---|
| 3,197,323 | A | * | 7/1965 | Rehmar | 106/404 |
| 3,579,366 | A | * | 5/1971 | Rehmar | 106/641 |
| 3,642,509 | A | * | 2/1972 | Fujimasu | 106/287.1 |
| 4,266,980 | A | * | 5/1981 | Chudo et al. | 106/692 |
| 4,340,427 | A | * | 7/1982 | Sutton | 106/640 |
| 4,565,578 | A | * | 1/1986 | Sutton et al. | 106/404 |
| 4,961,790 | A | * | 10/1990 | Smith et al. | 106/725 |
| 5,018,906 | A | * | 5/1991 | Bonier-Sahuc | 106/498 |
| 5,193,941 | A | * | 3/1993 | Wilson | 106/641 |
| 5,401,312 | A | * | 3/1995 | Hanst | 106/706 |
| 5,542,977 | A | * | 8/1996 | Hanst | 106/706 |
| 5,820,302 | A | * | 10/1998 | Roberts et al. | 106/606 |

FOREIGN PATENT DOCUMENTS

| | | | |
|---|---|---|---|
| KR | 936533 | 11/1994 | E02D/5/00 |
| KR | 145637 | 5/1998 | C09K/17/00 |
| KR | 989869 | 5/1998 | E02D/3/12 |
| KR | 195688 | 2/1999 | E02D/3/02 |
| KR | 226153 | 7/1999 | E02D/3/10 |
| KR | 256843 | 2/2000 | E02D/3/12 |

* cited by examiner

*Primary Examiner*—J. J. Swann
*Assistant Examiner*—Kathy Mitchell
(74) *Attorney, Agent, or Firm*—Abelman, Frayne & Schwab

(57) ABSTRACT

A method for strengthening a weak stratum using a solidified composition is provided. The method comprises the steps of: forming a horizontal drainage layer on the weak stratum; building-up mound structures on the drainage layer-formed weak stratum to the critical mound height; vertically forming holes in weak stratum; and mixing a first mixture comprising 25–35 parts by weight of cement, and on the basis of 100 parts by weight of the cement, 0.2–0.4 parts by weight of high fluid adjustment and 0.1–0.2 parts by weight of gel retardant, with a second mixture composed of 65–75 parts by weight of dried sand having a particle size of 0.074–5.0 mm, and on the basis of 100 parts by weight of the cement, 0.3–0.8 parts by weight of aluminum powder, then introducing the first and second mixture into the holes.

3 Claims, No Drawings

SOLIDIFIED COMPOSITION TO STRENGTHEN WEAK STRATUM AND CONSTRUCTING METHOD USING THE SAME

BACKGROUND OF THE INVENTION

1. Field of the Invention

The present invention relates, in general, to a solidified composition to strengthen weak stratum and a construction method using the same. More specifically, the present invention relates to a solidified composition to strengthen weak stratum being moist to saturation, such as reclaimed lands; or dredge hydraulic fill-lands including coastal swampy lands, rivers, lakes, harbors and the like, and a construction method using the same, which has much shorter solidification time and greatly improved strength, compared with a method using a common cement solidifier.

2. Description of the Prior Art

Generally, weak stratum being moist to saturation, such as reclaimed lands or hydraulic fill-lands including coastal swampy lands, rivers, lake or harbors, is dehydrated by various methods, and thus totally solidified and uniformly hardened, thereby preventing settlement of the weak stratum and securing bearing capacity on construction. Accordingly, economical construction methods, capable of rapidly strengthening weak stratum, and also methods for uniformly hardening weak stratum are required.

In the prior arts related to these methods, Korean. Pat. No. 226153 refers to a method for strengthening weak stratum by ejecting high pressure water and compressed air from a nozzle mounted on the front end portion of an injection rod, to bore into the stratum soil, introducing water to the weak stratum and mixing to obtain paste, which then drains onto the surface of the land; while simultaneously introducing stratum-strengthening materials, such as sand, gravels or ready mixed concrete through a wide bore injection rod, whereby the stratum-strengthening materials can be substituted for weak stratum and thus allow the paste in the upper part to push up to the surface of the land.

Korean Laid Open Pat. No. 93-006533 refers to a method for increasing bearing capacity in soft ground, which comprises crossing reinforcements in the form of cross stripes with the aid of crossed downwardly connected reinforcements on evenly mounded land, with each intersection being fixed by welding, inserting the projected shaft into the central parts of bottom of concrete turbinate piles, driving the piles into the ground to form a uniform arrangement of piles, and filling the broken stone having a size of 1–40 mm between the concrete turbinate piles by use of a vibrator to prevent lateral flow by mutual action of the piles and the filled broken stone, so as not to settle the ground.

Korean Laid Open Pat. No. 97-024623 discloses a method for consolidation grouting the subsurface by excavating the subsurface to a certain depth, charging a grout-introducing rod to excavation boring, thereby raising the rod from the lowest parts of the boring.

Korean Laid Open Pat. No. 98-009869 refers to a method for strengthening weak stratum by drilling the lower parts of drain pipes buried in land to form a plurality of holes in the pipes; inserting check valves to each hole to supply and disperse compressed air to the land through the drain pipes, thereby causing pore collision in the soil; separating water contained in the soil from the soil to discharge the separated water onto the land through the drain pipes by a pressure of compressed air.

These methods, so called general consolidation dehydration (facilitation) methods, increase the strength of the stratum by draining excess pore water through drainage means under excess pore water pressure generated within the weak stratum in the presence of the load of the mound structure. However, the methods suffer from the disadvantages of greatly lengthening draining periods, environmental problems such as devastation of agricultural lands attributed to flowing excess pore water in the land, deformation of drainage means according to settlement of ground, or loss of drainage function of excess pore water caused by subsidence of horizontal drain layer (the reason for which is unknown), thereby occurring shear failure from loss of strength owing to loss of normal drainage function.

In addition, Korean Pat. No. 145637 is related to a method for preparing a powdered solidifier comprising 50–200 kg of cement per 1 $m^3$ of weak ground, 10–20% of fly ash and 1–3% of lignin sulphonate, on a basis of the weight of the cement, disclosing the strengthening of weak stratum by mixing said solidifier with water of 0.5–1 $m^3$ and then agitating, followed by introduction of the mixture into the weak ground.

Korean Pat. No. 195688 refers to a method for uniformly and firmly hardening weak stratum by constructing limestone piles in central parts of assistant drain-mounted dehydration portion, to hydrate excess pore water within the weak stratum with the limestone pile, thereby rapidly adsorbing subsurface water and simultaneously dehydrating excess pore water in the weak stratum by chemical dehydration and physical expansion force.

This method refers to a caking method, wherein cement paste of water and cement (or lime) is introduced into the inner parts of the original natural soft ground stratum, thus forcibly mixing (mechanically mixing or ejecting under high pressure) or caking, thereby increasing the strength of the soft ground stratum. The method is advantageous in terms of short construction period of time, compared to a general consolidation dehydration method, but has disadvantages of being very expensive and generating industrial wastes by discharging large quantities of subsurface slurry onto the ground during forcible mixing. Accordingly, there remains a need for treating such wastes.

There is thus a widely recognized need for a method for securing soft ground stratum strength by drainage and dehydration of excess pore water and simultaneous caking effect within very short period of times.

SUMMARY OF THE INVENTION

With the above problems in mind, the present inventors provide a solidified composition in dried state.

Therefore, it is an object of the present invention to provide a solidified composition to strengthen weak stratum, capable of greatly shortening solidification time and rapidly improving strength.

It is another object of the present invention to provide a construction method for strengthening weak stratum using the solidified composition.

In accordance with an embodiment of the present invention, there is provided a solidified composition comprising 25–35 parts by weight of cement and 65–75 parts by weight of dried sand having a particle size of 0.074–5.0 mm, and on the basis of 100 parts by weight of the cement, 0.3–0.8 parts by weight of aluminum powder, 0.2–0.4 parts by weight of powdered high fluid adjustment and 0.1–0.2 parts by weight of powdered gel retardant.

In accordance with another embodiment of the present invention, there is provided a construction method using the solidified composition, comprising the steps of: forming a horizontal drainage layer on the weak stratum; building-up mound structures on the drainage layer-formed weak stratum to the critical mound height; vertically forming holes in said weak stratum; and mixing a first mixture comprising 25–35 parts by weight of cement, and on the basis of 100 parts by weight of the cement, 0.2–0.4 parts by weight of high fluid adjustment and 0.1–0.2 parts by weight of gel retardant, with a second mixture composed of 75–85 parts by weight of dried sand having a particle size of 0.074–5.0 mm, and on the basis of 100 parts by weight of the cement, 0.3–0.8 parts by weight of aluminum powder, then introducing the first and second mixture composition into the holes.

DETAILED DESCRIPTION OF THE INVENTION

A composition to strengthen weak stratum according to the present invention comprises 25–35 parts by weight of cement, 65–75 parts by weight of sands with a dried particle size of 0.074–5.0 mm, and based on 100 parts by weight of said cement, 0.3–0.8 parts by weight of aluminum powder, 0.2–0.4 parts by weight of high fluid adjustment in powder form and 0.1–0.2 parts by weight of gel retardant in powder form.

In the present invention, it is preferred that the used cement, sand and aluminum powder have little moisture content in order to increase their water absorption rates upon introduction into weak stratum. If moisture is present in the composition, irregular strength properties due to separation of materials are created and also the mixture composition has difficulty in being introduced into holes in the weak stratum. In the composition of the present invention, Portland, useful as the cement, is preferably used at an amount of 25–35 parts by weight. When the amount is less than 25 parts by weight, the moisture content in the weak stratum is insufficiently decreased, and thus the strength of the weak stratum remains weak. Meanwhile, when the amount exceeds 35 parts by weight, the weak stratum adjacent to porous sand pile has nearly moisture content but unit water content necessary to hardening the composition are deficient in the porous sand pile of the center and thus the strength is tend to be lowered. Also, it is preferred that sand used in drainage channels has a particle size of 0.074–5.0 mm, through which excess pore water present within the weak stratum can be easily passed. Additionally, sand having such particle sizes, contained in the composition of the present invention is hardened with the cement so as to increase the strength of the weak stratum. If the particles are too small, the drainage channel function and the strength are lowered. On the other hand, if the particles are too large, the strength properties become ununiformity because of separation of materials caused by irregular particle shapes. As such, sands are preferably used at an amount of 65–75 parts by weight. When the amount is less than 65 parts by weight, the cement is used at relatively large amounts, thereby greatly decreasing the moisture content of the weak stratum, and causing the porous sand pile to be reduced in strength owing to the separation of the materials. Whereas, when it exceeds 75 parts by weight, the used amount of the cement is relatively small, thereby lowering the effect of decreasing the moisture content of the weak stratum and the strength of the pile.

The aluminum powder useful as a foaming agent in the cement composition is used at an amount of 0.3–0.8 parts by weight, based on the 100 parts by weight of the cement. An amount less than 0.3 parts by weight results in reduced drainage channel function, because the foam is generated in smaller amounts, whereas an amount exceeding 0.8 parts by weight leads to lowering the strength, due to formation of large numbers of pores by the large amounts of foaming. In addition, naphthalene-based or melanin-based high fluid adjustment of dried powder forms, 0.2–0.4 parts by weight, is used so that fluidity on mixing of said composition becomes good, thereby increasing the degree of dispersion. As such, if the amount of the high fluid adjustment is less than 0.2 parts by weight, the fluidity is decreased and thus the materials are separated in the porous sand pile. On the other hand, if the amount exceeds 0.4 parts by weight, the strength properties are abruptly lowered. Naphthalene-based or melanin-based gel retardant in powder form is used at an amount of 0.1–0.2 parts by weight in order that rapid hardening reaction is prevented, thereby leeching water contained in the weak stratum for a prolonged period of time. But, the use of excess retardant results in drastically lowering the strength properties.

In accordance with the present invention, mound structures are artificially built-up on the weak foundation. As soon as the composition is introduced into the soil, excess pore water pressure is generated and thus the pore water is rapidly penetrated into the dried composition under high pressure, absorbed and thus allows the composition to harden (cake). At that time, while the generated foam is expanded, such expansion pressure causes excess pore water to be continuously generated. Thusly generated excess pore water is rapidly penetrated into said composition, absorbed and thus the composition is hardened (caked).

All conventional concretes are prepared by simultaneously mixing water, cement and aggregate, to form a paste; pouring the paste into a certain mold, then hardening. However, in the present invention, excess pore water pressure is forcibly created in the weak stratum and the pore water is rapidly penetrated into the composition under high pressure, absorbed and then hardened (subsurface excess pore water and pore water act to harden the composition), thereby preparing the concretes. By the actions of rapidly dissipating excess pore water pressure and caking the composition, while excess pore water pressure occurring within the weak stratum is rapidly dissipated, the strength of the stratum is increased. In addition, the caked composition has a friction piling effect of porous sand piles. Accordingly, the method of the present invention is a rapid stratum-strengthening method.

More specifically, by use of the present method for rapidly strengthening weak stratum within one or two months, mound working on soft soil foundations (equal to sandy foundation) may be performed with trafficability insurance of the equipment, and a horizontal drainage layer useful as a drainage path of excess pore water present on the surface of the weak stratum is formed. Additionally, when the mound structures are stably built-up on the weak stratum, excess pore water pressure proportional to the mass of the mound structure is generated in the weak stratum, and thus used to harden (cake) the composition.

Then, the mound structure is rapidly built-up to the critical mound height, calculated by a common method. Vertical cylindrical holes in the weak stratum are made by use of a rotary casing auger-drill or a casing-vibro hammer. The composition introduced into the soft soil through these holes rapidly adsorbs subsurface excess pore water generated by the mound load, and subsurface excess pore water created on formation of holes with the casing. As such, foams are generated and thus the volume is expanded. Also, horizontal expansion pressure is additionally generated, causing additional excess pore water pressure. When the excess pore water is rapidly penetrated into the composition under the higher pressure and then dissipated, the composition is hydrated with such subsurface pore water and then rapidly hardened, thus forming porous sand piles in the soft soil. The area around weak stratum is naturally increased in its strength, by a rapid stratum dehydration. Hence, the weak stratum is rapidly strengthened.

In the composition, cement, high fluid adjustment and gel retardant are determined as a first mixture, and the wholly dried sand and aluminum powder as a second mixture. When introduced into the holes formed in the weak stratum, these materials are mixed on the spot. In addition, the introduced amount is adjusted in a range of 70–600 kg per $m^3$ of the weak stratum, depending on the moisture content of the weak stratum.

The surface of the porous sand piles hardened in the subsoil is porous, and its body is composed of comparatively plain condition concrete, thus exhibiting a predetermined compressed strength ($\sigma \geqq 50$ kg/$cm^2$), whereby the porous sand piles have the function of friction piles supporting a load, and drainage function rapidly dissipating excess pore water pressure in case of generation of additional excess pore water pressure. Therefore, the soft soil stratum can be rapidly strengthened. Also, in case of earthquake in loose sandy stratum, the generated excess pore water is fast drained and liquification of the loose sandy stratum can be prevented, attributable to said friction support pile functions.

A better understanding of the present invention may be obtained in light of the following examples which are set forth to illustrate, but are not to be construed to limit the present invention.

EXAMPLE 1

In an iron test-box which is 1.5 m×1.5 m×1.5 m, agitated marine clay having liquid limit of about 50.4% plastic limit of about 34.8% and moisture content of about 60%, was filled to the height of 1.2 m, onto which a sand layer of about 20 cm depth was built, thereby forming a horizontal drainage stratum. To the unconsolidated undrained condition; shear test for thusly formed clay was conducted by use of portable vane test, thus measuring its shear strength of Suo≅1.0 t/$m^2$.

In order to build a mound structure on the weak stratum in the test box, the load condition for the critical mound height calculated by a common method was obtained from the following formula, $\sigma_v = r_t \cdot Hc = r_t \cdot 5.6 \cdot Suo / r_t \cdot Fs$, wherein Fs is given as 1.25 and Suo is given as average approximately 1.0 t/$m^2$. So, an iron plate of 1.5 m×1.5 m should have been placed on the sand under 10 ton of steel ingot, but the size of the iron test box was so small that the mass of 5.0 ton according to $\sigma_3 = Ko\ \sigma_v$ was used.

The construction intervals in the weak stratum were set at 0.3 m ×0.3 m. As shown in the following table 1, sand, foaming agent, and cement, and high fluid adjustment and gel retardant were separately mixed and then the two mixtures were mixed in situ, then introduced into the weak stratum at an amount of 180–230 kg/$m^3$ of weak stratum. This mixture was introduced into the simulated construction structure by use of a small casing hand auger-drill having a steel tube outer diameter of 125 mm and a thickness of 2.3 mm.

EXAMPLE 2

In an iron test-box which is 1.5 m×1.5 m×1.5 m, agitated marine clay having liquid limit of about 50.4%, plastic limit of about 34.8% and moisture content of about 80%, was filled to the height of 1.2 m, onto which a sand layer of about 20 cm depth was built, thereby forming a horizontal drainage stratum. To the unconsolidated undrained condition; shear test for thusly formed clay was conducted by use of portable vane test, thus measuring its shear strength of Suo'≅0.8 t/$m^2$.

In order to build a mound structure on the weak stratum in the test box, the load condition for the critical mound height calculated by a common method was obtained from the following formula, $\sigma_v = r_t \cdot Hc = r_t \cdot 5.6 \cdot Suo / r_t \cdot Fs$, wherein Fs is given as 1.25 and Suo is given as average approximately 0.8 t/$m^2$. So, an iron plate of 1.5 m×1.5 m should have been placed on the sand under 8.0 ton of steel ingot, but the size of the iron test box was so small that the mass of 4.0 ton according to $\sigma_3 = Ko\ \sigma_v$ was used.

The construction intervals in the weak stratum were set at 0.3 m×0.3 m. As shown in the following table 1, sand, foaming agent, and cement, and high fluid adjustment and gel retardant were separately mixed and then the two mixtures were mixed in situ, then introduced into the weak stratum at an amount of 180–230 kg/$m^3$ of weak stratum. This mixture was introduced into the simulated construction structure according to the same method as described in the example 1.

TABLE 1

| | Cement | Sand (dry) | Foaming agent | High fluid adjust-ment- | Gel retardant |
|---|---|---|---|---|---|
| Examp. 1 | 550 kg | 1650 kg | 0.5 parts by weight based on 100 parts by weight of cement | 0.3 parts by weight based on 100 parts by weight of cement | 0.1 parts by weight based on 100 parts by weight of cement |
| Examp. 2 Component | 750 kg Portland cement | 1500 kg Marine sand Land sand (river sand) Crushed sand | Aluminum powder | Powdered naphtha-lene products (Econex Co. Ltd.) | Powdered naphtha-lene based products (Econex Co. Ltd.) |

Used sand: the fraction (less than 3.0%) of sand which passes through a No. 200 sieve (totally dried)

20 days after the simulated construction was completed in accordance with the examples 1 and 2, the physical properties were measured as follows.

1) Confirming permeability

After the simulated construction, the shear strength of the clay stratum was measured with a portable vane tester. In order to confirm the decreased moisture water content, a sample was collected and then measured for moisture water content and specific gravity. The hardened porous sand pile was recovered, then the sample was cut by a Diamond Core cutter, followed by closely adhering the cut sample to a cylindrical rubber membrane. Then, a variable head permeability test was conducted.

2) Measuring porosity of porous sand pile

Weights of dried state and underwater state of the sample were measured and the specific gravity was determined. The sample was sealed with paraffin, and then its volume was measured, thereby obtaining a porosity measurement.

3) Strength properties

Cut portions of the upper and the lower parts of the sample were capped and then uniaxial compression strength (Wet Condition) was measured.

4) The strength of strengthened clay layer was measured by standard methods by use of the portable vane test.

According to the results of the experiments, while excess pore water pressure is rapidly dissipated in the weak clay layer between the hardened porous sand piles, the moisture water content of the clay stratum is drastically reduced (instant reduction effect of moisture water content of about 8–30%). Because of such reduction of moisture water content, rapid increase of stratum strength ($\Delta$ Su=3–7 t/m$^2$) by a critical state theory is exhibited. The hardened porous sand pile has a compression strength of about 50–200 kg/cm$^2$, and permeability is shown as a permeable coefficient, $K>3\times10^{-3}$ cm/sec (in some samples, a flow channel is formed and thus permeability is not measured). The hardened porous sand pile and the area around weak stratum are rapidly strengthened so that complex stratum is formed, thereby greatly improving a diminution effect of stratum settlement and a bearing capacity.

By the stratum settlement operation, excess pore water primarily generated proportional to the load of the mound structure, and additional excess pore water secondarily created by expansion effect during hardening are rapidly adsorbed to form complex stratum. Accordingly, the hardened porous sand pile exhibits an elastic behavior, and surrounding clay is changed to unsaturated state. Hence, very slight consolidation settlement and elastic settlement are seen together.

The section of the hardened porous sand pile is porous and has uniform porosity of 10–30%. So, the drainage function (in conventional vertical drain method) is retained under the additional load of the mound structure. It is believed that vertical deformation of the stratum occurs for 4 days in the presence of the load of the mound structure and thus the stratum is irregularly settled, and then settling stops. As such, the generated excess pore water pressure is dissipated within a very short period of time.

In case of earthquake in the loose sandy soil, the hardened porous sand pile allows the relative density of the loose stratum to drastically increase, thereby forming very large shear resistance. Excess pore water pressure created in the sandy foundations is rapidly dissipated by drainage function of the porous sand pile, so as to have excellent liquification prevention effect.

As described above, the present invention has advantages as follows: 1) the hardened porous sand pile has bearing capacity, 2) surrounding weak stratum is increased in its strength, 3) friction pile effects by said 1) and 2) effects can be obtained, 4) drainage effects can be obtained by the rapid drain function of the hardened porous sand pile, 5) near by construction is not affected by other effects and excess pore water is not drained to the outer areas, thus preventing environmental problems, and the weak stratum is not happen to the settlement under additional load of neighboring soil, 6) according to the success of a simulated test of the present method, we expect that a full scale test can be successfully performed, and 7) after constructing the porous sand pile in the soil, the construction period is ready for development within one month.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method for strengthening a weak stratum using a solidified composition comprising the steps of:

forming a horizontal drainage layer on the weak stratum;

building-up mound structures on the drainage layer-formed weak stratum to a critical mound height;

vertically forming holes in said weak stratum; and mixing a first mixture comprising 25 to 35 parts by weight of cement, and on the basis of 100 parts by weight of the cement, 0.2 to 0.4 parts by weight of high fluid adjustment and on the basis of 100 parts by weight of the cement, 0.1 to 0.2 parts by weight of gel retardant, with a second mixture composed of 65 to 75 parts by weight of dried sand having a particle size of 0.074 to 5.0 mm, and on the basis of 100 parts by weight of the cement, 0.3 to 0.8 parts by weight of aluminum powder, then introducing the first and second mixture into the holes.

2. The method of claim 1, wherein the amount introduced of the first and second mixture is 70 to 600 kg per m$^3$ of weak stratum.

3. The method of claim 1, wherein the holes used for the introduction of the mixture are formed by use of a rotary casing auger-drill or a casing-vibro hammer.

* * * * *